United States Patent [19]

Aarons

[11] 4,096,671

[45] Jun. 27, 1978

[54] ROOF EAVE ASSEMBLY

[75] Inventor: Raymond Joseph Aarons, Jindalee, Australia

[73] Assignee: Monier Colourtile Pty. Ltd., Darra, Australia

[21] Appl. No.: 804,880

[22] Filed: Jun. 9, 1977

[51] Int. Cl.[2] ..... E04B 7/00; E04D 1/00

[52] U.S. Cl. ..... 52/94; 52/520; 52/542; 52/556

[58] Field of Search ..... 52/11, 12, 94–96, 52/520, 521, 519, 543–552, 542, 556

[56] References Cited

U.S. PATENT DOCUMENTS

| | | | |
|---|---|---|---|
| 521,087 | 6/1894 | Jennings | 52/22 |
| 606,996 | 7/1898 | Marshall | 52/94 |
| 761,138 | 5/1904 | Bird et al. | 52/22 |
| 2,801,601 | 8/1957 | Riedel | 52/11 |
| 3,137,970 | 6/1964 | Tiernan | 52/95 |

FOREIGN PATENT DOCUMENTS

| | | | |
|---|---|---|---|
| 718,025 | 10/1954 | United Kingdom | 52/547 |

*Primary Examiner*—James L. Ridgill, Jr.
*Attorney, Agent, or Firm*—Maky, Renner, Otto & Boisselle

[57] ABSTRACT

A roof eave assembly for tiled roofs includes a sarking support running beneath the tiles and over the upper edge of a fascia board to give a firm sloping support for sarking. The support includes a flange in front of the fascia board in spaced relationship therewith and spaced apertures to allow the support to be fastened to the fascia board and to the roof rafters. When in use, the eave course of tiles may be secured to the fascia by means of spaced eave tile clips snapped onto the front flange of the sarking support.

7 Claims, 2 Drawing Figures

ROOF EAVE ASSEMBLY

BACKGROUND OF THE INVENTION

This invention relates to Sarking Supports for use on tiled roofs and an Eave Tile Clip which secures the eave course of tiles to the Sarking Support. The Sarking Support is a support running beneath the tiles to the upper edge of a fascia board to give a firm sloping support for sarking, and ensure run off of water on the sarking clear of the building.

Sarking Supports, also called "anti-ponding boards", have in the past been made from wood, usually tapered from the fascia back to the roof rafters. These boards are butted and fixed behind the fascia board so that the top of the board is flush with the rear top edge of the fascia. A continuous packing batten is fixed to the top of the rafter immediately behind the fascia, so that the timber ponding board can be supported in its correct position and prevent sagging caused by the weight of the roof tilers working on the roof.

Cost of materials and labor in such installations has been high.

SUMMARY OF THE PRESENT INVENTION

The objects of this invention are to provide a roof eave assembly having a sarking support of simple design, which is economical to install and provides an attachment for an eave tile clip of special design.

A further object is to provide a sarking support of sheet material which may be made as long as required, not needing jointing between lengths.

Accordingly the invention comprises a sarking support of thin sheet material, including a normally sloped portion to lie beneath the tile and sarking, a downward flange to lie over the front surface of the fascia, and spaced apertures along each edge for fastening the support to the top edge of the fascia and to roof rafters.

The sloped portion may have several downward longitudinal ribs for added strength.

With thin metal or plastic sheet construction, the thickness needed for adequate strength is much less than for wood. This enables the support to be passed over, rather than being butted against the fascia while maintaining the necessary slope.

The front flange has three functions. First, it greatly increases the rigidity of the support; second, it acts as a means of connecting eave clips; and thirdly, it acts as a support in itself to direct water run off correctly into guttering.

An eave tile clip according to the invention includes a generally U-shaped metal body having a lower and an upper leg joined by a normally vertical web, and an upward flange on the end of the lower leg embracingly to engage the front flange on the sarking support to connect the clip to the sarking support.

The upper leg of the clip in use lies over an eave tile of a roof, with the web abutting the tile edge. The spring of the clip and its configuration ensures that the upper leg presses firmly on the tile to support and positively hold the eave tile in position.

BRIEF DESCRIPTION OF THE DRAWINGS

In order that the invention may be better understood, an embodiment will be described with reference to the accompanying drawings, in which.

DETAILED DESCRIPTION OF THE INVENTION

Figure 1:
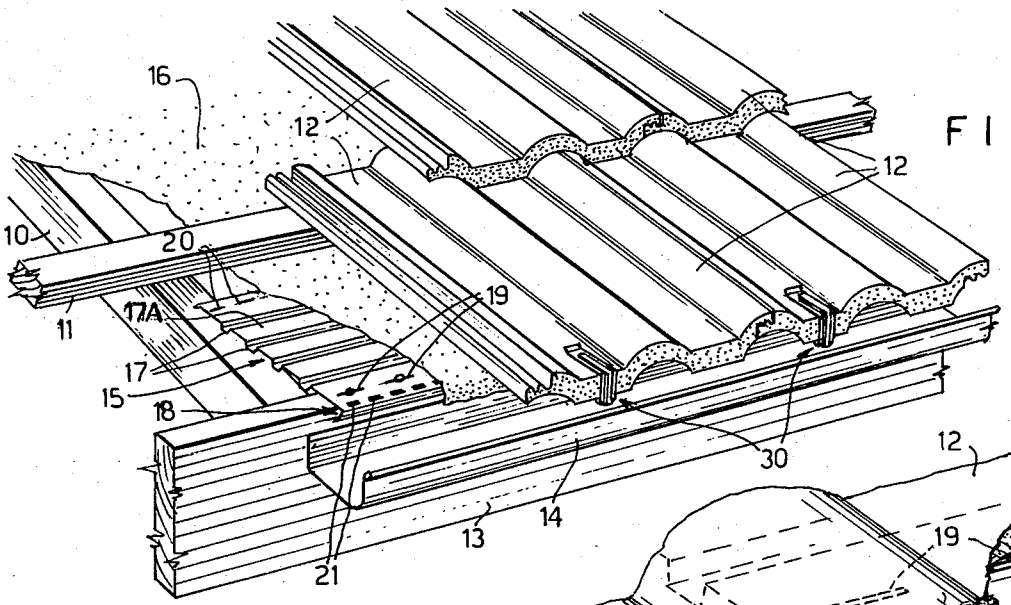
FIG. 1 shows a perspective view of part of a roof assembly using the sarking support and eave clip of the invention.

The assembly of FIG. 1 shows a roof having rafters 10, tiling battens 11, tiles 12, and a fascia board 13. A gutter 14 is attached in the usual way to fascia 13.

The sarking support 15 of the invention is of sheet material and underlies sarking 16 and tiles 12. The sarking support has longitudinal squared corrugations 17 formed in its sloped surface 17A, and has a forward, downwardly extending hooked flange 18. The sloped surface 17A of a sarking support is provided with two rows of laterally spaced slots 19, 20 and has a row of integrally formed indentations 21 laterally spaced from but immediately adjacent to the lower edge of such donwardly sloped surface.

Figure 2:
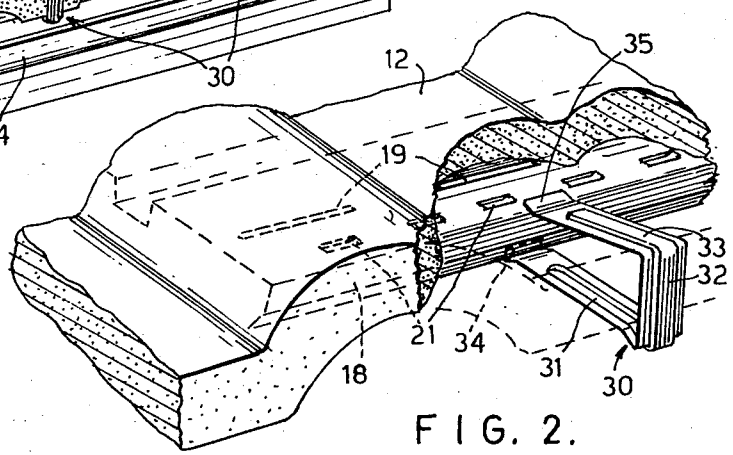
FIG. 2 shows an enlarged view of part of FIG. 1.

The metal tile clip 30 of the invention (FIG. 2) has a lower leg 31, a web 32 and an upper leg 33 forming a generally U-shaped body. Leg 31 has an upward flange 34 on its end, and leg 33 is preferably upwardly inclined at 35 to air engagement with a tile 12. The clip 30 is ribbed to provide additional rigidity and springiness.

In use, the sarking support 15 is laid with flange 18 in front of fascia 13 and is secured to the top of fascia 13 by nailing through slots 19, and to rafters 10 by nailing through sots 20. Sarking 16 and tiles 12 are laid and clips 30 pressed onto the ends of tiles 12. Because of their opposite hooked forms, flanges 34 may be snapped into engagement with the back edge of hooked flange 18 between such flange and fascia 13, thereby securing clips 30 in place. Indentations 21 are placed in the sarking support behind its front lip so as to engage the front edge of fascia 13 and therefore locate flange 18 at the correct distance in front of the fascia to permit flange 34 of clip 30 to be snapped into position behind and against flange 18.

Corrugations 17 give strength to sarking support 15 and a non-slip feature for tilers standing on it, no packer batten being necessary beneath it.

Various changes and modifications may be made in the embodiment described without departing from the invention.

I claim:

1. In a tiled roof having a fascia, rafters and sarking material, a roof eave assembly comprising a sarking support of thin sheet material including a normally sloped portion to lie beneath the tiling and sarking and to extend over said fascia and a downward flange to lie in front of the fascia, integral spacing means on said sarking support laterally spaced from the downward flange and adapted to engage the fascia to space the flange from said fascia, and means to fasten the sloped portion of said support to the top edge of said fascia and to the roof rafters.

2. The roof eave assembly as claimed in claim 1, including a U-shape tile clip having an upper leg which extends over and engages an eave tile, a lower leg passing beneath said tile, and an upward flange on said lower leg clampingly to engage with said downward flange of said support.

3. The roof eave assembly as claimed in claim 1 wherein said means to fasten includes spaced apertures adjacent each longitudinal edge of the sloped portion of said support.

4. The roof eave assembly claimed in claim 1 further including longitudinal downward ribs in the material of the sloped portion of said support.

5. The roof eave assembly as claimed in claim 3, in which said spacing means includes a downwardly extending deformation in said material of the sloped portion of said support in a longitudinal line behind its front edge.

6. The roof eave assembly as claimed in claim 5 wherein said deformation consists of a series of indentations.

7. The assembly as claimed in claim 2, wherein the end of said upper leg is upwardly inclined.

* * * * *